United States Patent [19]

Blakeslee et al.

[11] Patent Number: 4,755,105

[45] Date of Patent: Jul. 5, 1988

[54] IMPELLER IMPROVEMENT

[75] Inventors: G. Allen Blakeslee, Bellefonte; Frederick E. Coffman, State College, both of Pa.

[73] Assignee: Chemcut Corporation, State College, Pa.

[21] Appl. No.: 923,385

[22] Filed: Oct. 27, 1986

[51] Int. Cl.[4] ..... F04D 29/18

[52] U.S. Cl. ..... 415/141; 416/240

[58] Field of Search ..... 415/140, 141, 214; 416/132 R, 132 A, 240, 241 A

[56] References Cited

U.S. PATENT DOCUMENTS

| | | | |
|---|---|---|---|
| 815,738 | 3/1906 | Prosser | 416/81 |
| 2,079,942 | 5/1937 | LeVelle | 416/87 |
| 2,123,146 | 7/1938 | Preston | 416/240 |
| 2,182,161 | 12/1939 | Nielsen | 416/132 R |
| 2,646,261 | 7/1953 | Poirot | 261/30 |
| 2,669,188 | 2/1954 | McIntyre | 415/141 |
| 2,737,373 | 3/1956 | Kinley | 416/3 |
| 2,979,288 | 4/1961 | Klein | 244/55 |
| 3,734,638 | 5/1973 | Ebsary | 415/141 |
| 3,759,630 | 9/1973 | Freeman et al. | 416/132 |
| 3,814,251 | 6/1974 | Bielawa | 244/17.19 |
| 3,938,260 | 2/1976 | Brenner et al. | 416/87 X |
| 4,008,985 | 2/1977 | Schemmann et al. | 415/141 X |
| 4,177,012 | 12/1979 | Charles | 416/132 A |
| 4,187,055 | 2/1980 | Barnstead | 416/132 A |
| 4,347,038 | 8/1982 | Hayashi et al. | 416/132 A |
| 4,393,650 | 7/1983 | Pool | 60/39.093 |
| 4,595,338 | 6/1986 | Kolm et al. | 416/81 |

FOREIGN PATENT DOCUMENTS

| | | | |
|---|---|---|---|
| 874531 | 8/1961 | United Kingdom | 416/240 R |
| 2114675 | 2/1982 | United Kingdom . | |

*Primary Examiner*—Robert E. Garrett
*Assistant Examiner*—Joseph M. Pitko
*Attorney, Agent, or Firm*—Paul & Paul

[57] ABSTRACT

An impeller is provided that is adapted to be rotationally driven, and which is constructed of a resiliently stretchable elastomeric material, such that, with increased centrifugal force that is applied to the impeller vanes with increased rotation of the impeller, the impeller increases in diameter and provides increased output performance beyond the output performance of a non-stretchable impeller of the same general size as the impeller at rest.

12 Claims, 1 Drawing Sheet

IMPELLER IMPROVEMENT

BACKGROUND OF THE INVENTION

In the impeller art, and specifically in the art of blower impellers, it is known to rotate an impeller within a housing to generate air flow from the housing in order to perform various functions. For example, in U.S. Pat. No. 4,017,982, the disclosure of which is herein incorporated by reference, an air blower is utilized for providing a high volume of air flow, that may or not be heated, for drying printed circuit boards, often in a somewhat corrosive atmosphere. In instances where corrosive substances might be encountered by a blower, blower components, and the impeller itself, and even more specifically, the vanes of the impeller, may be constructed of various materials that are adapted to withstand corrosive environments. Such materials can be metals such as stainless steel, or can be synthetic materials such as polyvinylchloride.

It is also known that impellers, fans, propellers and the like may be constructed of softer materials, such as rubber, for the purpose of preventing damage to the hand of a user, such as in the case of an open bladed fan, as in U.S. Pat. No. 2,123,146, or in the case of U.S. Pat. No. 2,182,161.

It is additionally known that fan blades can change in shape with rotation as in U.S. Pat. No. 3,759,630 or 4,177,012, or in pitch, as in U.S. Pat. No. 4,187,055. Furthermore, it is known that propellers, blades and the like, can be extended in length, radially outwardly with rotation, by various mechanical mechanisms, such as in U.S. Pat. Nos. 2,079,942 and 3,814,351.

SUMMARY OF THE INVENTION

The present invention is directed to increasing the output performance of an impeller, and the blower or other device utilizing the impeller, by constructing the impeller of a material that is sufficiently flexible and elastic within the elastic limit of the material, that the impeller will stretch radially outwardly with increased rotation, to provide delivery of increased flow volume per unit time and/or output flow pressure, relative to a non-stretchable impeller of the same general diameter at rest.

Accordingly, it is a primary object of this invention to provide an improved impeller.

It is a further object of this invention to provide an improved blower or other device utilizing an improved impeller.

Other objects and advantages of the present invention will be readily apparent to those skilled in the art from a reading of the following brief descriptions of the drawing figures, the detailed descriptions of the preferred embodiments, and the amended claims.

BRIEF DESCRIPTIONS OF THE DRAWING FIGURES

DETAILED DESCRIPTIONS OF THE PREFERRED EMBODIMENTS

Figure 1:
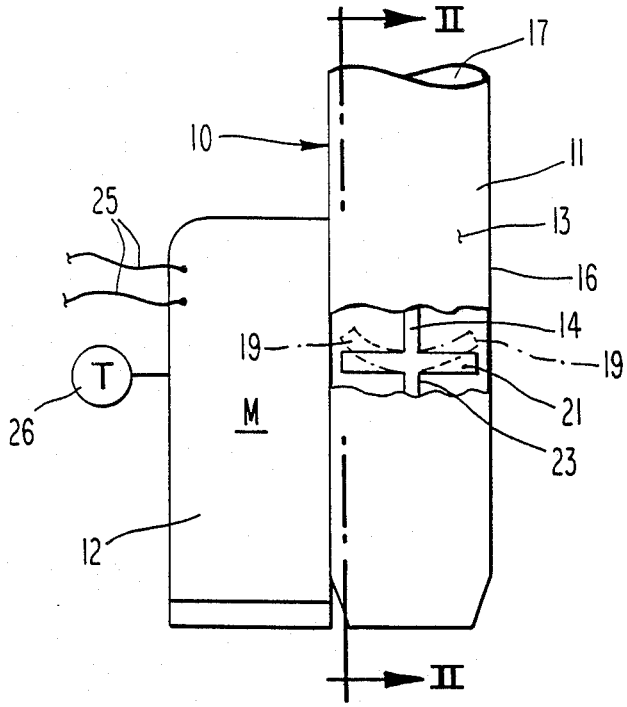
FIG. 1 is a side elevational view of a motor driven blower, taken looking from the right side of FIG. 2, utilizing an impeller in accordance with this invention, with a portion of the blower housing being broken away for the sake of clarity, to illustrate the "cupping" of an impeller vane therein when rotated at a sufficient speed to effect the same.
Figure 2:
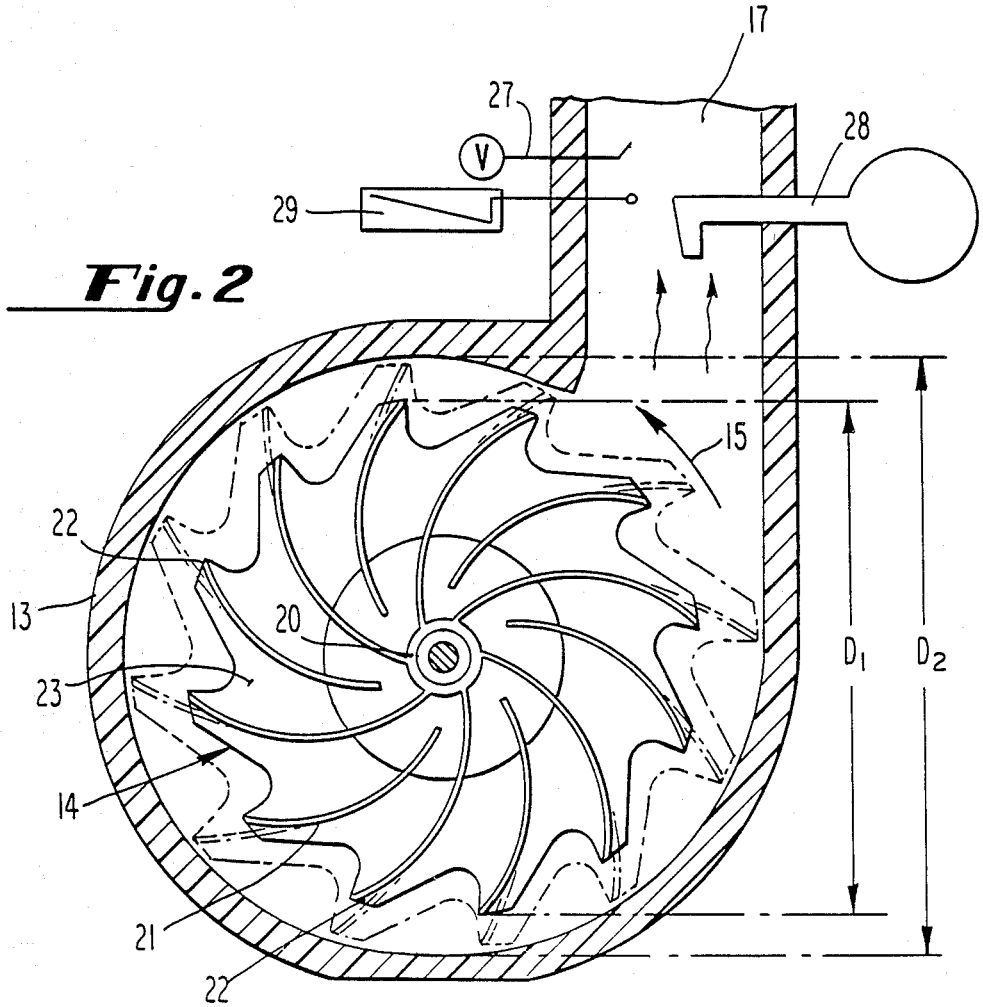
FIG. 2 is a vertical sectional view, taken through the blower housing of FIG. 1, and wherein the impeller is shown in full lines in its rest configuration, and with the impeller also being framentally illustrated in phantom in its "stretched" configuration, along with certain measuring instruments being schematically illustrated.

Referring now to the drawings in detail, reference is first made to FIG. 1, wherein a blower motor assembly is generally designated by the numeral 10, as in including a blower 11 and a motor 12, with the motor being connected to the housing 13 of the blower 11, in a conventional manner, and with the rotor (not shown) of the motor 12 being connected to the impeller 14 of the blower 11, also in a conventional manner for rotation of the impeller 14 in the counter-clockwise direction of the arrow 15 illustrated in FIG. 2.

The housing 13 will conventionally have air inlets, such as suitable openings, not shown in the wall 16 thereof, and will have a discharge end for air output at 17.

The impeller 14 will generally have a central hub 20 about which a plurality of vanes 21 are disposed, extending in a general outward radial direction from a generally central portion of the impeller at or near the hub 20, to their tips 22, although preferably in arcuate configuration such as that shown for the vanes in FIG. 2. The vanes are generally connected by suitable web portions 23, generally planar in arrangement, with the vanes 21 extending outwardly on each side of the web portions 23, as for example in the general arrangement illustrated in FIG. 1 for the fragmentally open portion of the housing, with the vanes extending axially rightward and leftward as viewed in FIG. 1.

It will be noted that as used herein, the term "impeller" is used in the broadest generic sense, to encompass various propellers, rotors and the like. Similarly, the term "vane" as used herein is intended to encompass blades and like devices adapted to work on fluid media.

The impeller, and especially its vanes, and generally its various web portions as well, are constructed of a material that is capable of stretching in use and then returning to its original configuration. That is, the material is of a generally flexible elastomeric material that is sufficiently extensible within its elastic limit that, in use, the impeller may be rotated such that sufficient centrifugal force is generated to cause the impeller, and especially its vanes, to "grow" along the lines illustrated in FIG. 2, from the full line positions therefor, to the phantom line positions illustrated therefor, such that the impeller generally grows from an original diameter $D_1$, to a stretched diameter $D_2$, as illustrated in FIG. 2.

While the impeller 14 hereof is described as being of a flexible elastomeric stretchable material, it will be understood that certain portions, for example, such as radial innermost portions such as the hub, may be constructed of other materials, such as metal or plastic materials, that may be used to securely fasten the impeller to the rotor of a motor, in that such portions of the impeller need not stretch to perform in accordance with the present invention.

The stretchable parts of the impeller (such as the vanes and the web) have been found to function desirably when the material of construction is a polyurethane. It has also been found that the softer the urethane, the greater is the elastic growth under the centrifugal force conditions of rotation. For example, a polyurethane material having a Shore durometer hardness of 80A underwent a stretching or growth of about 2 inches in diameter, over and above the diameter $D_1$ and 14 inches at rest, for a final diameter $D_2$ of 16 inches at a speed of rotation of 3450 revolutions per minute. Under similar conditions, another, somewhat harder, polyurethane material, with a Shore A durometer hardness of 90, resulted in an increase in diameter of about 1⅛ inches, under the same other general conditions. Still another polyurethane material, even harder, with a Shore D durometer hardness of 55, underwent a diameter growth of about 3/16 inches, again, under the same general conditions.

The polyurethane impeller discussed above having an 80A Shore hardness had a specific gravity of 1.13, an ultimate tensile strength of 5500 pounds per square inch, an ultimate elongation prior to rupture of 550 percent, and tensile modulus in pounds per square inch of 550, 700 and 1600 at elongations of 50%, 100% and 300%, respectively. The polyurethane impeller discussed above having a 90A Shore hardness had a specific gravity of 1.14, an ultimate tensile strength of 6200 pounds per square inch, an ultimate elongation prior to rupture of 430 percent, and a tensile modulus in pounds per square inch of 1100, 1530 and 3400 at elongations of 50%, 100%, and 30%, respectively. The polyurethane impeller discussed above having a 55D Shore hardness had a specific gravity of 1.15, an ultimate tensile strength of 6500 pounds per square inch, an ultimate elongation prior to rupture of 400 percent, and a tensile modulus in pounds per square inch of 1950, 2600 and 4900 at elongations of 50%, 100% and 300%, respectively.

Comparison tests were made between a non-stretchable standard 14 inch molded 12 vane impeller of polyvinylchloride construction, as compared with a 14 inch molded 12 vane impeller of polyurethane construction, with the comparison results in terms of output performance, specifically as measured in terms of operating pressure at output, and the volume of flow in cubic feet per minute, being as indicated on the charts produced below. In each case, the cross-sectional area of the discharge end was varied from 0 to 0.0483 square feet to get optimum operating pressure and output volume per unit of time as shown. The operating pressure at the discharge end is measured by a manometer or any other suitable means. The velocity is the peak air velocity at the discharge end.

ated with that output, are substantially greater for the stretching impeller that is the subject of the present invention, than for a non-stretching standard impeller.

Additionally, impellers in accordance with the present invention have been found to provide excellent flexing life, very good chemical resistance, high physical strength, better resistance to temperature than with standard polyvinylchloride impellers, and a wide range of hardness.

With reference again to the illustrations of FIGS. 1 and 2, it will be seen that, when the motor 12 is rotated by means of suitable electrical attachments, as at 25, to a source of electric power, a rotation of the motor will provide a rotation which enables the centrifugal force that is generated to cause the impeller to grow. In making tests of the type discussed above, the motor speed may be controlled by a suitable tachometer, schematically shown at 26. Additionally, the output pressure of air being delivered by the impeller 14 through discharge lines 17 may be measured my means of a suitable manometer 29, disposed in the air stream as illustrated in FIG. 2, in a conventional manner or by any other conventional pressure measuring device. Additionally, the volume of flow produced per unit of time, such as in CFM may be measured by a suitable volume measuring device 27, likewise disposed in the air stream toward discharge 17, as illustrated. The velocity of air may be measured by any suitable velocity-determining device 29.

It will be noted from FIG. 1 that the vanes "cup" in an opposite (upward) direction to that which would be expected considering the resistance they would encounter from the fluid medium in which they are working; namely, air. This is due to the effect of centrifugal force on their oppositely extending edges 19 which substantially overcomes the air resistance.

It will be apparent that impellers and especially impeller vanes in accordance with this invention may be made of various elastomeric flexible materials that have the ability to stretch during use, as described above, with the ability to regain their original shape and size thereafter. Additionally, it will be apparent that various constructions of vanes or blades for impellers, propellers, rotors or the like may be also be made within the spirit and scope of the invention. Similarly, the impellers may be used with or without various housings, and may work with air, liquid, or various fluid media de-

| | 1 | 2 | 3 | 4 | 5 | 6 | 7 | 8 |
|---|---|---|---|---|---|---|---|---|
| | STANDARD NON-STRETCHING IMPELLER | | | | | | | |
| Area (Sq. Ft.) | 0 | .0069 | .0138 | .0207 | .0276 | .0345 | .0414 | .0483 |
| Static Pressure (In. of $H_2O$) | 11¾+ | | | | | | | |
| Operating Pressure (In. of $H_2O$) | | 11¾+ | 12+ | 12½ | 12½ | 12 | 11¾ | 11½ |
| Velocity (Ft./Min.) | | 13726 | 13871 | 14157 | 14157 | 13871 | 13726 | 13579 |
| Volume (CFM) | | 94.7 | 191.4 | 293 | 390.7 | 478.5 | 568.3 | 655.8 |
| | STRETCHING IMPELLER (Shore 80A Hardness) | | | | | | | |
| Area (Sq. Ft.) | 0 | .0069 | .0138 | .0207 | .0276 | .0345 | .0414 | .0483 |
| Static Pressure (In. of $H_2O$) | 14½ | | | | | | | |
| Operating Pressure (In. of $H_2O$) | | 14½ | 14¾ | 15¼ | 15½ | 15 | 14¾ | 14½ |
| Velocity (Ft./Min.) | | 15248 | 15379 | 15637.6 | 15765 | 15508 | 15379 | 15248 |
| Volume (CFM) | | 105.2 | 212.2 | 323 | 435 | 535 | 636.7 | 736.5 |

As the charts above demonstrate, the output in terms of flow per unit time, and the operating pressure associpending upon the circumstances of use, all within the spirit and scope of the invention.

What is claimed is:

1. An impeller adapted to be rotationally driven and having a generally central hub and at least one vane extending radially outwardly and being carried by the hub, with the vane being comprised of a generally flexible elastomeric material that is sufficiently extensible within its elastic limit that the vane stretches radially outwardly along its length, to have greater length under the centrifugal force of impeller rotation.

2. The impeller of claim 1, wherein the vane is generally parallel to the axis of the hub, connected thereto by a web portion with the vane additionally being sufficiently elastically flexible that it reconfigures from a linear-like configuration and assumes a cup-like configuration under the centrifugal force of impeller rotation.

3. The impeller of claim 1, wherein at least one web is provided, connecting the vane and hub, and wherein the web is sufficiently extensible within its elastic limit, that the web stretches radially outwardly under the centrifugal force of impeller rotation.

4. The impeller of claim 3, wherein the web is generally planar in radial disposition.

5. An impeller adapted to be rotationally driven from a hub, and having a generally central hub and a plurality of vanes extending radially outwardly of and being carried by the hub, and terminating in vane tips, with the vanes being comprised of a generally flexible elastomeric material that is sufficiently extensible within its elastic limit that the vanes stretch radially outwardly along its length, to have a greater length when the impeller is rotationally driven such that:

(a) a surface of revolution defined by the tips of the vanes when the impeller is rotationally driven is of a greater diameter than the surface of revolution defined by the vane tips when the impeller is at rest; and (b) the impeller output performance increases with the increase in diameter of the surface of revolution of the vane tips when rotationally driven.

6. The impeller of claim 5, wherein the impeller is disposed in a housing, with the housing having a housing discharge, and wherein the vane material is sufficiently stretchable that the output performance increases in flow volume per unit of time of flow through the discharge, with the increase in diameter of the surface of revolution.

7. The impeller of claim 6, wherein the impeller is disposed in a housing, and that the housing having a housing discharge, and wherein the vane material is sufficiently stretchable that the output performance increases in output flow pressume at discharge, with the increase in diameter of the surface of revolution.

8. The impeller of claim 5, wherein the impeller is disposed in a housing discharge, and wherein the vane material is sufficiently stretchable that the output performance increases in output flow pressure at discharge, with the increase in diameter of the surface of revolution.

9. The impeller of claim 5, wherein the vanes are disposed generally parallel to the axis of the hub, connected thereto by suitable correction portions.

10. The impeller of claim 5, wherein at least the vanes thereof are made of a polyurethane material.

11. The impeller of claim 5, wherein there are a plurality of webs connecting the vanes and hubs and wherein the webs are sufficiently extensible within their elastic limit that the webs stretch radially outwardly under the centrifugal force of impeller rotation.

12. The impeller of claim 11, wherein the webs are generally planar in radial disposition.

* * * * *